United States Patent [19]

Terwee et al.

[11] 4,051,658

[45] Oct. 4, 1977

[54] METHOD OF MANUFACTURING TWISTLESS YARN AND YARN MADE BY THIS METHOD

[75] Inventors: Thomas Henricus Marie Terwee, Enschede; Jan Nijhuis, Hengelo, both of Netherlands

[73] Assignee: Hollandse Signaalapparaten B.V., Hengelo, Netherlands

[21] Appl. No.: 649,706

[22] Filed: Jan. 16, 1976

[30] Foreign Application Priority Data

Feb. 10, 1975 Netherlands ..... 7501535

[51] Int. Cl.[2] ..... D02G 3/40; D02G 3/04

[52] U.S. Cl. ..... 57/140 BY; 57/157 TS; 57/164; 57/157 MS; 156/148

[58] Field of Search ..... 57/35, 164, 153, 36, 57/34 HS, 140 R, 140 BY, 157 R, 157 TS; 156/148

[56] References Cited

U.S. PATENT DOCUMENTS

| | | | |
|---|---|---|---|
| 3,512,232 | 5/1970 | Bolinger | 57/164 X |
| 3,548,462 | 12/1970 | Naegeli | 57/164 X |
| 3,577,872 | 5/1971 | Drummond | 57/164 X |
| 3,877,214 | 4/1975 | Van der Werf | 57/164 |

*Primary Examiner*—John Petrakes

*Attorney, Agent, or Firm*—Frank R. Trifari; David R. Treacy

[57] ABSTRACT

A method of manufacturing twistless yarn, in which a sliver or a roving consisting of a fibrous material containing at least two components, at least one being a potential adhesive, is wet-drafted, false twisted and then, after supplying additional moisture, bonded. After the application of additional moisture the fibrous sliver is passed through a narrow space and heated, such that only a small amount of moisture in the fibrous sliver evaporates and a rapid saturation of moisture in the space is obtained. The potentially adhesive component is thereby sufficiently activated by the residual moisture in the fibrous sliver.

8 Claims, No Drawings

METHOD OF MANUFACTURING TWISTLESS YARN AND YARN MADE BY THIS METHOD

The invention relates to a method for the manufacture of twistless or substantially twistless yarn and to the yarn manufactured by the application of that method. In applying this method a silver or roving, which consists of a fibrous material containing at least two components, at least one of which being a potential adhesive, is used as basic material. The basic material selected may therefore consist of staple fibre material with the addition of at least one potentially adhesive fibrous component, either staple fibres or a continuous filament, or of a bicomponent fibrous material with the potentially adhesive component at the fibre periphery. The processes to which the sliver or the roving is subjected include at least the wet-drafting of the sliver or the roving to form a thinner fibrous sliver, the false twisting and the bonding of this fibrous sliver; the bonding is thereby realized by activating the potentially adhesive component and drying the fibrous sliver.

Such a method is known from the U.S. Pat. No 3,877,214, where the activation and the drying occurs after winding into a package. This method has the disadvantage of the "migration phenomenon," as already indicated in the Canadian patent specification No. 985,885. The latter patent describes a solution to this migration problem by completing at least the activation and the drying prior to the winding of the fibrous sliver, viz, by bringing the fibrous sliver into direct contact with a heated surface, e.g., a drum. The activation could be started already before the wet-drafting by wetting the sliver or the roving with a heated liquid; in the case of drafting with a cold liquid, the activation could not be started until in direct contact with the heated surface. In the first case this led to contamination of both the drafting means and the heated surface, while in the second case only the heated surface was contaminated, although this gave rise to inferior activation. The latter problem could however be solved, as described in the Dutch patent application No. 74.06030, to which corresponds copending U.S. application Ser. No. 570,729 filed Apr. 23, 1975, now U.S. Pat. No. 4,007,580, by raising the reduced moisture content of the fibrous sliver to the required level after wet-drafting and false twisting. This was realized by squirting the fibrous sliver with a liquid jet, by passing it through a liquid or a liquid vapor, or by using the false twisting unit described in the Dutch patent application No. 74.11139 to which corresponds copending U.S. application Ser. No 598,013 filed July 22, 1975 by one of the co-inventors of the instant application. Contamination of the heated surface could not be prevented however.

It is an object of the present invention to provide a method for the manufacture of twistless or substantially twistless yarn, avoiding both the migration phenomenon and contamination of any machine parts.

To accomplish this object, a number of solutions have been found, where the fibrous sliver is activated and dried before winding without any contact between the fibrous sliver and machine parts. It has been tried to realize the activation and the drying by passing the wet fibrous sliver through a space into which hot air is blown; the heat transfer was however so small that a very low feedthrough speed had to be applied. This was accompanied by enormous moisture losses, impeding the activation process. As described in the above Canadian patent specification No. 985,885, the disadvantage that the fibres of the sliver to be fed through are blown apart is less pronounced here if, after the false twisting, an additional amount of moisture is applied to the sliver before it enters the activation and the drying space mentioned above. Another solution to accomplish the object is by using condensing steam instead of hot air; this solution is described in the Dutch patent application No. 73.14584 to which Swiss Pat. No. 576,019 corresponds. Athough this, i.e., activation by condensing steam, was a considerable improvement over activation by hot air, the means used for this method became considerably more complex through the need to install a steam line. There were indeed no moisture losses in comparison with the use of hot air so that an adequate activation was realized.

Another object of the invention is to provide a method for the manufacture of twistless or substantially twistless yarn, achieving a considerably higher feedthrough speed and arresting the evaporation of the moisture content required for the activation.

In accordance with the invention, after false twisting and the supply of additional moisture, the fibrous sliver is passed through a narrow space and heated, giving rise to evaporation of a small amount of moisture in the fibrous sliver and a rapid saturation of moisture in said narrow space, such that the potentially adhesive component is sufficiently activated by the residual moisture in the fibrous sliver. The heat may be applied in two different ways: firstly, through an electromagnetic field, generated at the fibrous sliver, e.g., in a radio-frequency furnace. In such a case, the above-mentioned narrow space through which the fibrous sliver is passed consists of a tube placed in such a furnace. There is no heat transfer limiting the feedthrough speed the moisture in the fibrous sliver is directly heated by the radio-frequency energy generated at the fibrous sliver. A small amount of moisture evaporates until an equilibrium is obtained between the moisture content in the fibrous sliver and that in the tube around the fibrous sliver, the residual moisture in the fibrous sliver is sufficient to enable a good activation. After the fibrous sliver emerges from the r.f. furnace, the moisture in the fibrous sliver is reduced to such an extent that no migration phenomena occur after winding. Such a process is termed "pre-drying." Drying is of course also possible by the application of r.f. heating, but this is very uneconomical: a considerably smaller amount of energy is expended in raising the fibrous sliver to the correct temperature as compared with maintaining the temperature until all moisture has disappeared. After activation by r.f. heating and pre-drying, as indicated above, the yarn so obtained may be dried, without contamination of machine parts, by direct contact with a heated surface prior to winding. This process is described in the Canadian patent specification No. 985,885. In the manufacture of twistless yarn by the application of the above method with the aid of an r.f. furnace, production rates up to 400–800 m/min are feasible. Secondly, heat may be applied by bringing the fibrous sliver in direct contact with a heated surface, which is provided with a shield situated at a very short distance from this surface. If a heated drum is used for this purpose, this drum together with the shield forms a narrow cylindrical gap. Through the direct contact a good heat transfer is obtained. Also in this case, only a small amount of moisture evaporates, and an equilibrium is established rapidly between the moisture contents in the fibrous sliver and that in the narrow cylindrical gap, ensuring a good activation through the residual moisture in the fibrous sliver. Although this method gives rise to contamination of the drum surface, this may be reduced considerably by heating the shield instead of the drum. By covering the drum only partly with the shield, the fibrous sliver will experience a very great reduction in its moisture content at the non-covered part of the drum; the fibrous sliver, meanwhile turned to yarn, is again predried and may then be further dried and wound, or first be wound (migration phenomena no longer appear) and then dried.

Various aspects of the method according to the invention are described hereinafter.

The basic material may consist of a sliver or a roving. A sliver is here defined as a bundle of parallel fibres, a roving a drafted and twisted sliver. Although a roving is thus twisted, a substantially twistless yarn may be obtained from it; for after the drafting of the roving another bundle of parallel fibre is obtained, viz. a thinner fibrous sliver. With the basic material being either a roving or a sliver and the application of a single draw frame, it is possible to arrive at a fibrous sliver of the desired thickness, producing after bonding the twistless yarn. For example, by employing the three-cylinder drafting means described in the Dutch patent application No. 74.04653, to which corresponds copending U.S. application Ser. No. 558,316 filed Mar. 14, 1975 by one of the co-inventors of the instant application, a twistless yarn can be produced directly from a sliver by the method according to the present invention.

The sliver or roving consists of a fibrous material containing at least two components, at least one of which being a potential adhesive. The basic material may therefore be as follows:

a. staple fibre material with the addition of at least one potentially adhesive component either as staple fibres or as a continuous filament. As staple fibre material showing no potentially adhesive properties, natural cellulose fibres such as cotton, synthetic cellulose fibres such as viscose-rayon fibres, and synthetic fibres such as polyester, polyacrylonitril and stabilized polyvinyl alcohol or suitable blendings of these fibres may be used. As potentially adhesive fibre component, fibres swellable, gelatinisable or soluble in water may be used, such as unstabilized polyvinyl alcohol (available and applicable as fibres or as continuous filament), and alginate fibres, as well as fibres soluble in organic solvents such as acetone, formic acid and acetic acid or mixtures of water with organic solvents, e.g., di- and tri-acetate fibres;

b. multicomponent fibres, of which at least one component at the fibre periphery is a potential adhesive, such as specially retted flax or a synthetic fibre with a polyvinyl alcohol envelope.

The sliver or roving is first drafted in a wet condition; the wet-drafting procedure, as well as the advantages connected therewith, is described in detail in the U.S. Pat. No 3,447,310, which however does not refer to the three-cylinder drafting means described in the aforementioned Dutch patent application No. 74.04653 and corresponding U.S. application Ser. No. 558,316. If a continuous filament is employed as potentially adhesive component — a filament of polyvinyl alcohol — this filament, as described in U.S. Pat. No. 3,945,186, can be added at the feed rollers of the drafting means, provided the polyvinyl alcohol has already been sufficiently activated. Since contamination is to be avoided, it is better to add the continuous filament at the last rollers of the drafting means.

After drafting, the thinner fibrous sliver so obtained is false twisted, for instance by the use of the false twisting unit of the U.S. Pat. No. 3,447,310. After false twisting more moisture is added; for the drafting and the false twisting processes reduce the moisture content in the thinner fibrous sliver, leading to inadequate activation. The false twisting and the supply of additional moisture may be realized with the aid of the false twisting means of the aforementioned Dutch patent application No. 74.11139 and corresponding U.S. application Ser. No. 598,013.

The potentially adhesive component of the fibrous sliver is subsequently activated. It has been found that during the heating process the temperature of the fibrous sliver does not increase beyond about 70° C, provided the fibrous sliver still contains sufficient moisture. The temperature of the fibrous sliver will not rise until the amount of moisture evaporated from the sliver is such that a good activation cannot be achieved. Provided a potentially adhesive component having a dissolving range below 70° C is used, sufficient activation is ensured by the heating of the wet fibrous sliver to produce a yarn of adequate strength. The phenomenon here described is a limiting factor in choosing the potentially adhesive component. Up to now a wet-spun polyvinyl alcohol fibre was commonly used for this purpose, viz. a PVA fibre spun in a sodium sulphate solution. Such a potentially adhesive fibre was used to activate the fibrous sliver on the heating drum, as described in the Canadian Dutch patent specification 985,885. The dissolving range of the potentially adhesive fibres now available and applicable in the process here described lies above 70° C. The application of these fibres however does not allow a good activation on a heating drum. This problem has been solved by arresting the evaporation of the moisture in the fibrous sliver during heating; the temperature of the fibrous sliver may then be raised above 70° C without considerable moisture loss. A part of the surface of the heating drum is thereto provided with a shield, such that during the heating of the fibrous sliver passing over the covered part of the drum an equilibrium is rapidly established, with little evaporation, between the moisture contents in the fibrous sliver and that in the gap between the drum and the shield. The disadvantage of contamination by bonding deposits on the drum surface will however be retained with the use of a heating drum. This contamination can largely be prevented by heating the shield in addition to the drum, allowing the drum temperature to be reduced.

Instead of a heating drum with a shield, the temperature of the wet fibrous sliver may be raised above 7020 C without considerable moisture loss by passing the fibrous sliver through a small diameter tube placed in the resonant cavity of an r.f. furnace. Without heat transfer, the temperature is raised above 70° C through the application of an electromagnetic field generated at the fibrous sliver. Also in this case, an equilibrium is rapidly established, without considerable moisture loss, between the moisture content in the fibrous sliver and that in the tube.

After activation a pre-drying process is applied. In this process moisture is extracted from the activated fibrous sliver until the sliver does not show any migration phenomena during further drying after winding on a suitable bobbin. The moisture content in the activated fibrous sliver then practically corresponds with the total amount of "swelling liquid" of the fibres in the strand; this is the liquid in the fibres and not in between the fibres. The drafted, activated and pre-dried sliver is of sufficient strength for winding.

If for the activation process a drum partly covered by a shield is used, the pre-drying will occur at the non-covered part of the drum. By choosing a suitable material for the drum surface, contamination of this surface can be checked. For instance, polytetrafluoroethylene may be used for this purpose.

In case an r.f. furnace is employed for the activation, the activated fibrous sliver, emerging from the tube placed in this furnace, will loose so much moisture that the sliver may already be wound in a pre-dried state.

After winding the activated and pre-dried fibrous sliver or the pre-dried yarn may be further dried.

It is of course possible to perform the entire drying process before winding by passing the activated fibrous sliver over the drum surface for a sufficient period of time or by applying r.f. heating. The latter method is however to be rejected for efficiency reasons.

EXAMPLE

As basic material a roving, consisting of 94.5% viscose rayon and 5.5% unstabilized polyvinyl alcohol fibres, was prepared. The imbibition value of the viscose rayon, that is the amount of water which can be absorbed in the fibres, expressed in a percentage by weight of the fibres, was 100%. The dissolving range of the polyvinyl alcohol fibres was 75°–80° C; the gellation or dissolving to a viscosity of 550 centipoise needed 700% water (with respect to the dry weight of the polyvinyl alcohol). From these data it was deduced that, to dissolve the polyvinyl alcohol in the roving to the above viscosity value, 133% of water (with respect to the dry weight of the roving) was required. Furthermore, the titre of the roving was 760 tex.

The roving was immersed in a water bath at a temperature of 20° C for a period of 3 seconds, then wet-drafted with a draft ratio of 15.3 (so that finally a 15 tex yarn could be obtained) and false twisted. This was followed by sprinkling with additional water. The moisture content of the fibrous sliver then amounted to 112% (again with respect to the dry weight of the sliver). The fibrous sliver thus moistened was passed to a heating drum, the delivery speed of the sliver being 200 m/min.

After 14 turns around the drum heated to 140° C, corresponding with a heating time of 2.1 sec at the given delivery speed, the temperature of the fibrous sliver was 76° C and its moisture content 38%, while 0.5 sec later the temperature of the sliver had increased to 87° C and the moisture content decreased to 27%. The Lea strength product of the yarn finally obtained was 1260.

After nine turns around the drum now heated to 160° C, corresponding with a heating time of 1.4 sec at the given delivery speed, the temperature of the fibrous sliver was 76° C and its moisture content 55%, while after 0.5 sec the temperature of the sliver had risen to 86° C and the moisture content decreased to 37%. The Lea strength product of the yarn finally obtained was 1320.

When however a heating drum provided with a shield was used, the yarn produced was found to be considerably stronger. An aluminum shield around a part of the heating drum at a distance of 1 mm from the surface contained a groove to feed in the fibrous sliver. After 10 turns around the covered part of the drum, corresponding with a heating time of 1.5 sec at the given delivery speed, and 5 turns around the non-covered part of the drum a yarn with a Lea strength product of 1750 was obtained. Although it could not be established to what extent the shield reduced the rate of evaporation of the water in the fibrous sliver, the evaporation was apparently checked in such a way that a considerably greater yarn strength was obtained.

It must be noted that 1 Lea is the test length of the yarn, corresponding with the length of 80 turns around a reel having a circumference of 1.5 yards, while the breaking strength of the yarn is the weight in pounds (avoir dupois) at which the 80-fold skein fractures and the Lea strength product is the product of this breaking strength and the English count. A yarn of 50 tax corresponds with the English count Ne 12. In the three cases above the breaking strength of the yarn obtained was respectively 105 lb, 110 and 145 lb, so that the Lea strength product was 1260, 1320 and 1750, respectively.

What we claim is:

1. Method for the manufacture of twistless or substantially twistless yarn from a sliver or a roving which consists of a fibrous material containing at least two components, at least one component being a potential adhesive, in which method the sliver or roving is subjected to a number of processes, including at least wet-drafting of the sliver or roving to a thinner fibrous sliver, false twisting, the supply of additional moisture and bonding of the fibrous sliver by activation of the potentially adhesive component, and drying of the fibrous sliver, wherein the step of activation of the potentially adhesive component comprises passing the fibrous sliver through a narrow space and heating the sliver therein, so that in said narrow space an equilibrium is reached between the amount of moisture in the fibrous sliver and in the narrow space surrounding the fibrous sliver at a temperature within the dissolving range of the potentially adhesive component, while maintaining a residual moisture content in the fibrous sliver sufficient for good activation.

2. Method for the manufacture of twistless or substantially twistless yarn as claimed in claim 1, wherein the fibrous sliver is activated by an electromagnetic field generated at the fibrous sliver.

3. Method for the manufacture of twistless or substantially twistless yarn as claimed in claim 2, wherein the fibrous sliver is activated in a radio-frequency furnace.

4. Method for the manufacture of twistless or substantially twistless yarn as claimed in claim 3, wherein the fibrous sliver is passed through a tube situated in the resonant cavity of the radio-frequency furnace.

5. Method for the manufacture of twistless or substantially twistless yarn as claimed in claim 1, wherein the step of activation comprises passing the fibrous sliver over a heating drum, said heating drum being partly covered by a shield, so that the fibrous sliver is activated at the covered part of the drum surface.

6. Method for the manufacture of twistless or substantially twistless yarn as claimed in claim 1, wherein the step of activation comprises passing the fibrous sliver over a drum, said drum being partly covered by a heated shield, so that the fibrous sliver is activated at the covered part of the drum surface.

7. Method for the manufacture of twistless or substantially twistless yarn as claimed in claim 1, wherein the fibrous sliver is predried after the activation and prior to the winding of said fibrous sliver.

8. Twistless or substantially twistless yarn manufactured by the application of the method as claimed in claim 1.

* * * * *